US006565459B2

(12) United States Patent
Gormley

(10) Patent No.: US 6,565,459 B2
(45) **Date of Patent: *May 20, 2003**

(54) TWO STAGE ATTACHMENT MEANS FOR LID AND BASE CONTAINER OF STANDS FOR TETHERBALL GAMES

(75) Inventor: Ian Gavin Gormley, Kwa Zulu Natal (ZA)

(73) Assignee: European Sports Merchandising BV, Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/956,826

(22) Filed: Sep. 21, 2001

(65) Prior Publication Data

US 2002/0028716 A1 Mar. 7, 2002

Related U.S. Application Data

(63) Continuation of application No. 09/489,825, filed on Jan. 24, 2000.

(30) Foreign Application Priority Data

Sep. 10, 1999 (ZA) ..... 99/5833

(51) Int. Cl.[7] ..... A63B 69/00; A63B 71/00

(52) U.S. Cl. ..... 473/423; 473/417; 473/430; 473/429; 220/324; 108/161

(58) Field of Search ..... 220/784, 601, 220/254, 324, 327, FOR 784, FOR 254; 248/127, 147, 158, 524, 346.01, 346.03; 473/422–429, 445, FOR 108; 108/161

(56) References Cited

U.S. PATENT DOCUMENTS

| | | | | |
|---|---|---|---|---|
| 1,873,693 A | * | 8/1932 | Whitefield et al. | 248/524 |
| 2,680,859 A | | 6/1954 | Hultberg | |
| 3,025,029 A | * | 3/1962 | Thomas | 248/524 |
| 3,688,942 A | | 9/1972 | Mitchell et al. | |
| 3,716,234 A | | 2/1973 | Lancellotti | |
| 3,759,415 A | | 9/1973 | Cloyd | |
| 3,784,136 A | * | 1/1974 | Lopez | 248/524 |
| 3,871,334 A | * | 3/1975 | Axelrod | 119/710 |
| 4,148,455 A | * | 4/1979 | Oliver | 248/524 |
| 4,295,680 A | | 10/1981 | Grasso | |
| 4,917,261 A | | 4/1990 | Starr | |
| 5,088,948 A | | 2/1992 | Scheurer | |
| D352,014 S | * | 11/1994 | O'Leary | 248/524 |
| 5,694,866 A | | 12/1997 | Borst | |
| 5,957,789 A | | 12/1997 | Ainscough et al. | |
| 6,032,827 A | | 6/1998 | Zettle et al. | |

FOREIGN PATENT DOCUMENTS

| | | | | |
|---|---|---|---|---|
| DE | 55585 | * | 4/1967 | 220/324 |

* cited by examiner

*Primary Examiner*—Paul T. Sewell
*Assistant Examiner*—Mitra Aryanpour
(74) *Attorney, Agent, or Firm*—Young & Thompson

(57) ABSTRACT

A stand for a vertical pole support for a tether ball type game includes a base which can contain ballast and a lid, through which the pole passes and a formation on its floor for receiving the end of the pole. The lid and base are attached by a two stage attachment arrangement. The first stage includes inter-engageable tongue and groove formations which are capable of attachment and detachment by application of finger pressure, and the second stage includes locking devices at points around the periphery of the base container for a positive lock of the lid to the base, so that the first stage cannot be broken other than by the use of excessive force having regard to the conventional use of the stand.

17 Claims, 12 Drawing Sheets

FIGURE 7
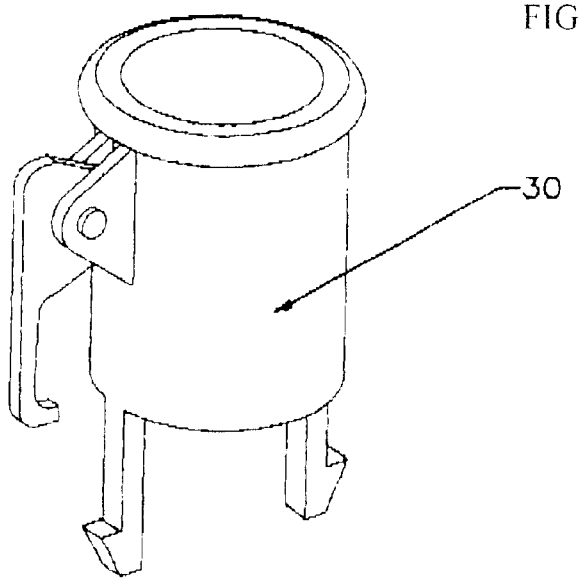
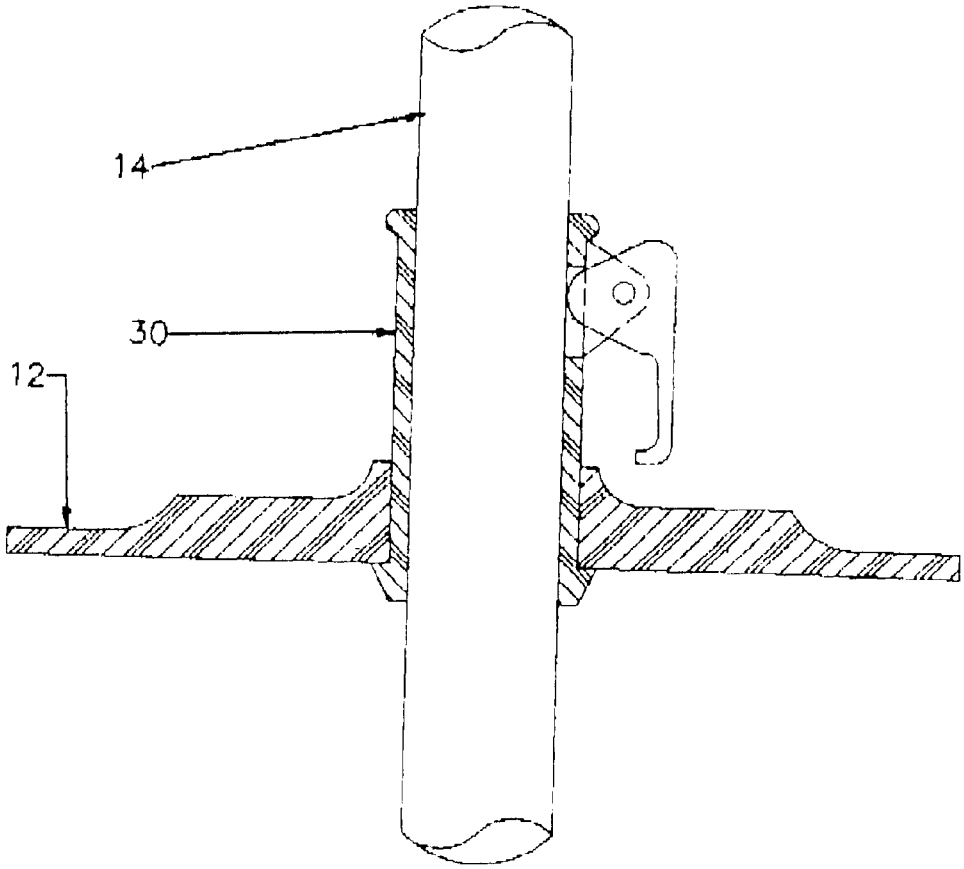
FIGURE 6

TWO STAGE ATTACHMENT MEANS FOR LID AND BASE CONTAINER OF STANDS FOR TETHERBALL GAMES

This application is a continuation of co-pending application Ser. No. 09/489,825, filed on Jan. 24, 2000, the entire contents of which are hereby incorporated by reference.

BACKGROUND OF THE INVENTION

This invention relates to movable stands for vertical pole support comprising a base container and a detachable lid, which may be filled with ballast material, in particular, but not necessarily, for stressful applications such as for games having a vertical pole of the tether-ball type, such as the tether tennis game known as "SWINGBALL" (Trade Mark) or the tethered soccer-ball game known as "SOCCER SWINGBALL" (Trade Mark), where the pole held by the stand may be subjected to violent shocks and pressures during the playing of such games. The stand may also conveniently be used for other sporting activities such as basketball, or other applications such as for holding umbrella poles.

In describing a stand as movable, this refers to the feature that such stands are not normally immovably fixed or positively anchored to the ground. When not filled with ballast, the stand is light and easily transportable. When filled with ballast, while providing stable support for a pole, it will still be practical to move the base from one location to another.

Tether tennis type games, such as "SWINGBALL" (Trade Mark), include a pole which traditionally has been anchored by forcing the lower end vertically directly into the ground, which is facilitated by a pointed lower end of the pole. The pole has a helical anchoring device at its upper end and a tennis type ball is tethered to this by a cord.

The game is played by the striking of the ball with racquets or paddles by opponents in opposite directions around the pole, causing the attachment of the line to the helix to rise up or down the helix.

The tethered soccer-ball game "SOCCER SWINGBALL" (Trade Mark), is similar to SWINGBALL (Trade Mark), except that the ball is substantially larger and heavier, of the football or soccer ball type, and the pole is shorter, so that the football may be kicked around the pole at ground level.

It will be appreciated that considerable stress can be transferred to the pole during play of games of this type and if the pole is anchored in soft ground, it has been found that the pole soon becomes loose. It will also be appreciated that it will not be possible to play games of this type where the pole is unable to be inserted into hard soil, or where the game is required to be played on any other type of hard surface which the pole end cannot penetrate.

Games of the tether tennis type have been marketed for many years and an on-going search has been mounted for a suitable stand to enable such games to be played on hard surfaces, where it is not possible to force the point of the pole into the ground, or where the ground is too soft to hold the pole firmly upright during play.

One of the main problems is that a suitable stand for games of this type has to be extremely robust to withstand the pressures and shocks which have to be absorbed by the stand during play.

One type of stand which has been tried for use with tetherball type games is the blow-moulded plastic beach umbrella stand. Typically these weigh about 2 to 4 pounds (approximately 1 to 2 kilograms) when empty, are blow-moulded in high density polyethylene plastic and have a filler hole on the top through which water, as ballast material, can be poured in, or out.

These stands normally have a capacity of about 0.5 to 1 cubic feet (approximately 15 to 25 liters), cover a surface area of about 1.5×1.5 feet (approximately 0.5×0.5 meters) and weigh about 30 to 50 pounds (approximately 15 to 25 kilograms) when filled with water as ballast material and are fitted with a central internal socket and clamping means to receive and hold the bottom end of a beach umbrella pole therein.

One of the problems with the use of blow-moulded stands of this type for tetherball games, is that the blow-moulding process distributes a layer of plastic material of uniform thickness over the surface of the mould, resulting in a reasonably uniform wall thickness of the stand. This makes it difficult to provide for localized thickened sections, so as to reinforce areas subject to particularly high stresses during play, such as the socket and the area adjacent, which holds the bottom end of the pole, or the area of the upper surface adjacent to the pole. After extended play stands of this type tend to rupture or split in these areas and are therefore unsuitable for use with tetherball games.

Blow-moulded stands are also bulky to store and transport, and while ballast material such as water may be added or removed through a filler hole, it is more laborious with sand or gravel, and, depending on the size of the filler hole (which may not be so big so as to compromise the structural integrity of the stand) virtually impossible to use large objects such as bricks or stones as ballast material.

An attempt to obviate the problem of bulkiness of stands for garden umbrellas has been made in U.S. Pat. No. 4,591,126 (Sheldon Berney), which provides for a base or stand having a base section and a separate lid portion.

This lid is designed to inter-connect to the base by a peripheral continuous snap sealing means of the tongue and groove type. However, no reference is made to any need to remove the lid from the base having been assembled, and in particular, no reference is made to the ease of removing the lid in terms of the pressure required to unlock the snap fit. This invention does not refer to the requirements of stressful applications, such as games of the tether tennis type, that the lid remain attached to the base during play, and also be easily detachable by young children, or that the seal between lid and base be effective for the containment of ballast material during such use.

A different type of stand, which did attempt to address the requirements of tetherball games, is described in U.S. Pat. No. 4,148,455. The stand in this patent comprises a base container for water or sand or other ballast, and has a formation for receiving the bottom end of the pole.

The removable lid has an orifice with formations, which co-act with a foot plate on the pole, so as to prevent rotation of the pole. There is however, no detailed reference or description of the peripheral sealing arrangement between lid and base in this patent. The problem with the design of this stand is that the lid is described as being "easily snapped in and out of place" (lines 42 and 43 of column two of U.S. Pat. No. 4,148,455).

There is no positive locking arrangement for the lid and base container apart from this "snap" action and under the pressure of shocks exerted in stressful applications such as the playing of tether ball games, the snap seal between the lid and the base can break loose allowing water ballast to spill freely out of the base container or even for the lid to become completely unseated from the base container. Because of this design defect, the stand is unsuitable for stressful applications such as tether ball type games and a stand according to U.S. Pat. No. 4,148,455 as far as is known has never been made available commercially.

As a general comment, as well as in referring to the above U.S. Pat. Nos. 4,591,126 and 4,148,455, it should perhaps be noted that when assessing the suitability of the design of stands for poles for use in stressful applications which have removable lids, and where such lids are designed to engage the base container with a "snap" fit, that snap sealing means of this type face the contradictory requirements of providing a strong attachment of the lid to the base, together with a contrasting need in applications such as envisaged in this patent application, for the joint to be easily releasable by young children.

In general therefore, a lid which engages with a releasable snap fit to a base container is not suitable for the applications envisaged by this patent application.

SUMMARY OF THE INVENTION

It is an object of this present invention to provide a robust movable stand for vertical pole support having a rigid, or semi-rigid, base container component and an easily detachable lid component, which will hold a pole in its mounted position, particularly for use in conjunction with stressful applications such as for games of the tether ball type, which will resist the violent jerks encountered during the play of these games, without the lid becoming free of the base container, and which will also maintain an effective seal between the lid and base container, so as to prevent the escape of water or other types of ballast through this joint during play.

It will be appreciated that this stand may also conveniently be used as apparatus for other sporting activities such as basketball, or for holding umbrella poles, or other applications, even though the shocks and pressures in these applications may not be as onerous as for games of the tetherball type.

According to the present invention, a movable stand is provided for vertical pole support in which the lid and base container components are attached together by a two stage attachment system which, in combination, provide an effective attachment between the lid and base container for use in stressful applications such as for games of the tetherball type as described previously.

The lid and container are rigid or semi-rigid, and preferably moulded from plastic materials. In addition, locking or clamping means may be provided to positively secure any pole which is mounted in the stand, so that the pole is unable to pull free from its mounted position in the stand, unless such locking means are released.

The primary attachment means between the lid and the base components consists of a complemental inter-engageable tongue and groove formation, in which the tongue member, of little width compared with its height in cross section, located around the periphery of the one component, fits into and is there enveloped and held closely by the groove at the periphery of the other component.

This primary attachment means implements an effective seal between the lid and base container which prevents water or other ballast from leaking out through the joint, should the base container be shaken or jolted, as can occur during play of games of the tetherball type.

An important aspect of this tongue and groove design is that at all points of this joint around the peripheries of the base container and lid, the tongue is held on both sides by the groove so as to resist at any point displacement of the lid relative to the base by shocks or jolts from either side which might be imparted during play of games of the tetherball type.

BRIEF DESCRIPTION OF THE DRAWINGS

Embodiments of the invention are described below with reference to the accompanying drawings that refer to the embodiments.

FIGS. 6–7 are drawings of an example of a type of detachable clamp which, in association with the lid, may be used to clamp the pole into its mounted position.

DESCRIPTION OF THE PREFERRED EMBODIMENTS

In a preferred form of the invention, the mating of the tongue and groove joint of the primary attachment system is achieved by the provision of a tongue which usually comprises the peripheral rim of the base container which has to be forced into a complimentary flexible groove, which is provided at the periphery of the lid of the stand, which flexes open or moves in relation to the tongue, so at to accommodate the insertion of the tongue, such flexibility being imparted by its design, and by the inherent characteristics of the material used in the manufacture of the groove which is preferably plastic.

Figure 4A:
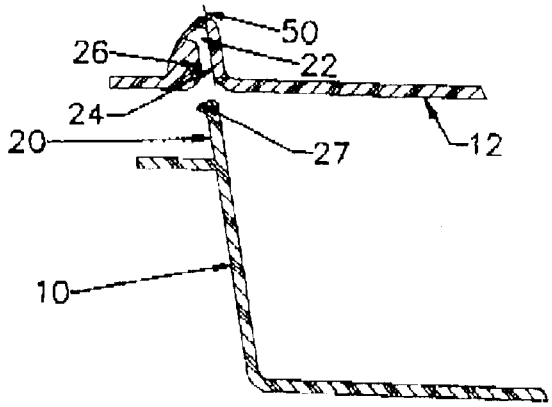
FIG. 4 comprises four enlarged cross-sectional drawings 4A, B, C and D, showing different phases of the mating of an example of a tongue and flexible groove joint which comprises the primary attachment system, having a tongue which, at its apex, is larger than the open mouth of the groove, and where the axis of the tongue and groove are at an obtuse angle to the axis of the base.
Figure 4B:
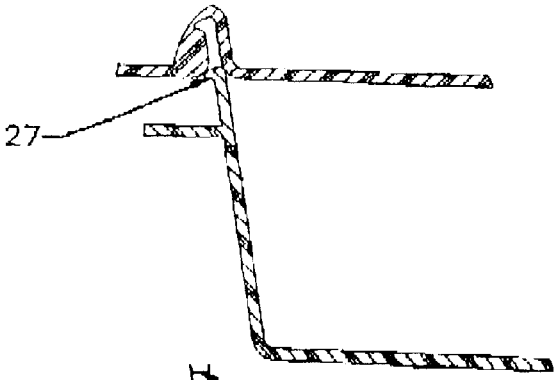
Figure 4C:
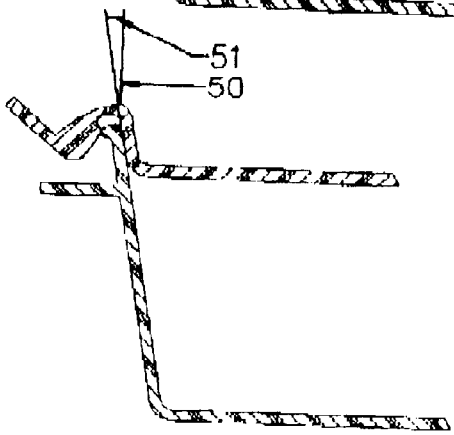

The fit of the tongue to the groove is such that either on initial presentation of the tongue to the opening of the groove, or during insertion of the tongue into the groove, the tongue is either larger than the groove, or the tongue and groove are vertically non-aligned with the base container which includes the position where the tongue and groove are at an obtuse angle 51 to the axis of the base container 50 (See FIG. 4C).

The tongue may therefore not be fully inserted into the groove unless, by the application of pressure, the flexible groove is forced open, or moved into alignment, or forced over the obtuse angle of the leading edge of the tongue.

Having opened or aligned the groove, the tongue is inserted to the maximum extent into the groove, in which position the tongue is enveloped and held closely by the groove.

The groove is so configured that, having been forced open to accommodate the full insertion of the tongue to the maximum extent, it is able, by virtue of its inherent flexibility and springiness, to spring or snap back substantially to its normal configuration. when not under stress, while enveloping the tongue. This spring action and bias of the groove towards its natural disposition when not under stress, positively restrains the enveloped tongue inside the groove in the fully closed position, where the tongue is inserted to tile maximum extent, unless sufficient force is exerted on the flexible groove so as to cause it to open to allow the release of the tongue.

While the tongue is of little width in relation to its height in cross section, the tongue may also possibly be hollow in cross section.

Although this primary attachment means provides an effective watertight seal, it is also designed for easy engagement or disengagement, and is characterized in that relatively light finger pressure of no more than about 20 pounds (approximately 10 kilograms), or preferably of the order of no more than about 5 pounds (approximately 3 kilograms) is required to press the tongue into the groove to the fully closed position.

In this regard finger pressure means the application of one or more fingers having a total area of the fingers exerting pressure over about 0.1 to 1 square inches (approximately 0.5 to 10 $cm^2$) and preferably between 0.25 and 0.75 square inches (approximately 2 to 5 $cm^2$).

Conversely, the application of finger pressure of not more than about 20 pounds (approximately 10 kilograms) or preferably of the order of no more than about 5 pounds (approximately 3 kilograms) is required to pull the tongue free from the groove of the primary attachment means.

With regard to these limits on the forces required to engage or disengage the tongue and groove seal of the primary attachment means, it has been found that these are the maximum reasonable pressures which can be reasonably expected to be exerted by children, should they wish to easily and quickly assemble or disassemble the lid and base container components.

A major feature of tongue and groove sealing designs of this type is that they are designed not only to join the lid and base snugly together in the closed position, but also to allow the easy attachment or separation of the lid and base, which facilitates the convenience of frequent use of the stand.

The problem that emerged during development and testing is that pressure and shock-loads considerably greater than about 20 pounds (approximately 10 kilograms), can be exerted on the joint between lid and base in stressful applications such as during the playing of tetherball games, which a joint of this type alone, conforming to this limit for engagement or disengagement purposes, is sometimes unable to contain, resulting in breaking of the seal, and the lid pulling loose from the base, so that play is no longer possible.

Stronger, heavy duty tongue and groove designs for attachment of lids to base containers are available which would resist such higher pressures during play, but which also require much greater attachment, or detachment, pressures. These are necessitated for example, in the sealing arrangements of plastic paint containers which obviously must not come undone even if dropped when full of paint.

The much higher attachment or detachment pressures required for the use of these heavy duty tongue and groove designs necessitate the application of considerable force and possibly, the use of tools or levers, which is unacceptable for domestic use, and particularly for children. It was therefore decided to provide additional, separate, secondary attachment means of a different nature, requiring little pressure and easy to engage, which would enable the primary seal to be maintained even if pressures or shock loads considerably higher than about 20 pounds (approximately 10 kilograms) are experienced.

A secondary attachment system is therefore also provided, which consists of the provision of two or more locking devices at points around the periphery of the base container. These locking devices are capable of attachment and detachment by the application of finger pressure of no more than about 20 pounds (approximately 10 kilograms) and preferably of the order of no more than about 1 pound (approximately 0.5 kilograms).

The locking devices positively lock the lid to the base container and prevent the extraction of the tongue from the groove of the primary attachment stage, or the detachment of the lid from the base container, except by the application of excessive force, having regard to the conventional use of the stand.

In view of the shocks and stresses generated in stressful applications such as during the playing of tether tennis type games and the resulting premature breakage problems experienced in this respect particularly while using stands of the blow moulded umbrella stand type, an extensive testing programme was undertaken with a stand according to this patent application, which was tested by the playing of a tether tennis type game. This included specific attention to the strength of the two stage attachment system, with particular reference to the tongue and groove primary attachment system which is of relatively light duty construction, so as to permit easy engagement or disengagement.

Tests were carried out with adult players, to the extent of hitting over 205,000 fill blows of a rigid faced bat on the tennis ball, which was followed by a further 32,000 blows with a full size, full weight, strung tennis racket. To some surprise, no serious flaws whatsoever became evident during this test programme.

At this point it was decided that the test programme thus far was more than adequate proof of the integrity of the stand, and as all concerned were exhausted, the test was terminated. It should be noted however, that the stand was still in very good condition, and it was probable that testing could have continued for even longer without risk of any breakage or failure.

As a result of this test programme it was conclusively established that a stand according to this patent application is able to withstand the severe conditions imposed when using the stand with games of the tether tennis type. In this regard it should be noted that it was discovered during the test programme that extensive long term testing is essential, as designs which after substantial initial testing appeared appropriate, subsequently failed during on-going further testing.

An additional option for the stand is the provision of clamping means associated with the lid, in the area of the hole in the lid through which the pole is inserted when mounting the pole in the stand, which positively secures the pole in its mounted position, so that it is unable to pull free unless the clamping means are released (as illustrated in FIG. 6).

A further feature may be provided by way of a vertical socket, or hollow tube, on the floor of the base container positioned under the hole in the lid for the pole. This socket may be provided with clamping means for the pole, and serves to isolate the end of the pole from the ballast material in the base container.

This facilitates the easy insertion and location of the pole into the stand, without the need for the end of the pole to pass through the ballast material, and protects the end of the pole from possible harmful effects of the ballast material, as would be case if the pole was left unprotected mounted for long periods in a base container filled with water, which could rust a metal pole, or rot a wooden pole.

A major advantage of a stand of this type is that game components or other articles can be stored within the stand. In addition, the components of this stand can be "nested" into each other when stored or shipped in bulk and offer great space savings compared with the blow-moulded containers of the type which are frequently used as umbrella stands, but which have no detachable lid which would enable "nesting".

Another advantage of a stand with a removable lid is that it is easy to fill the container not only with ballast material such as water or sand, but with ballast made up from relatively large objects, such as rocks, stones or bricks, or water or sand-filled bottles.

Figure 1A:
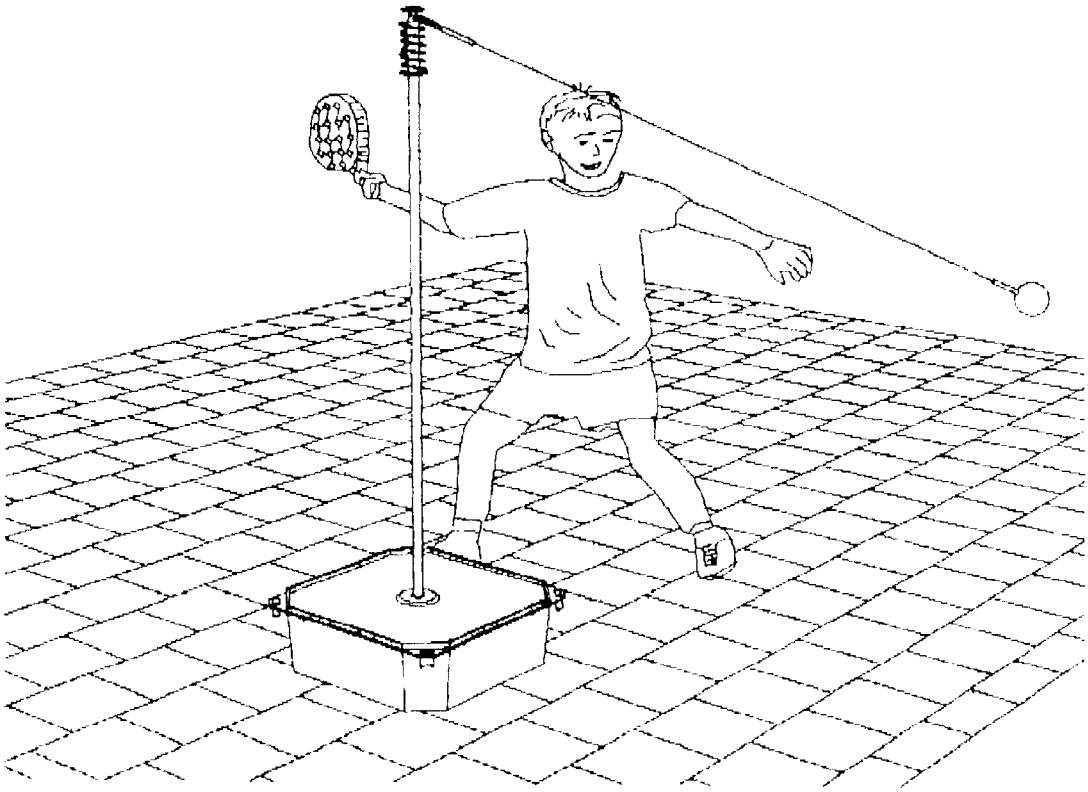
FIG. 1 is a general arrangement drawing showing the stand in use on a hard surface during play of a tether tennis type game.
Figure 1B:
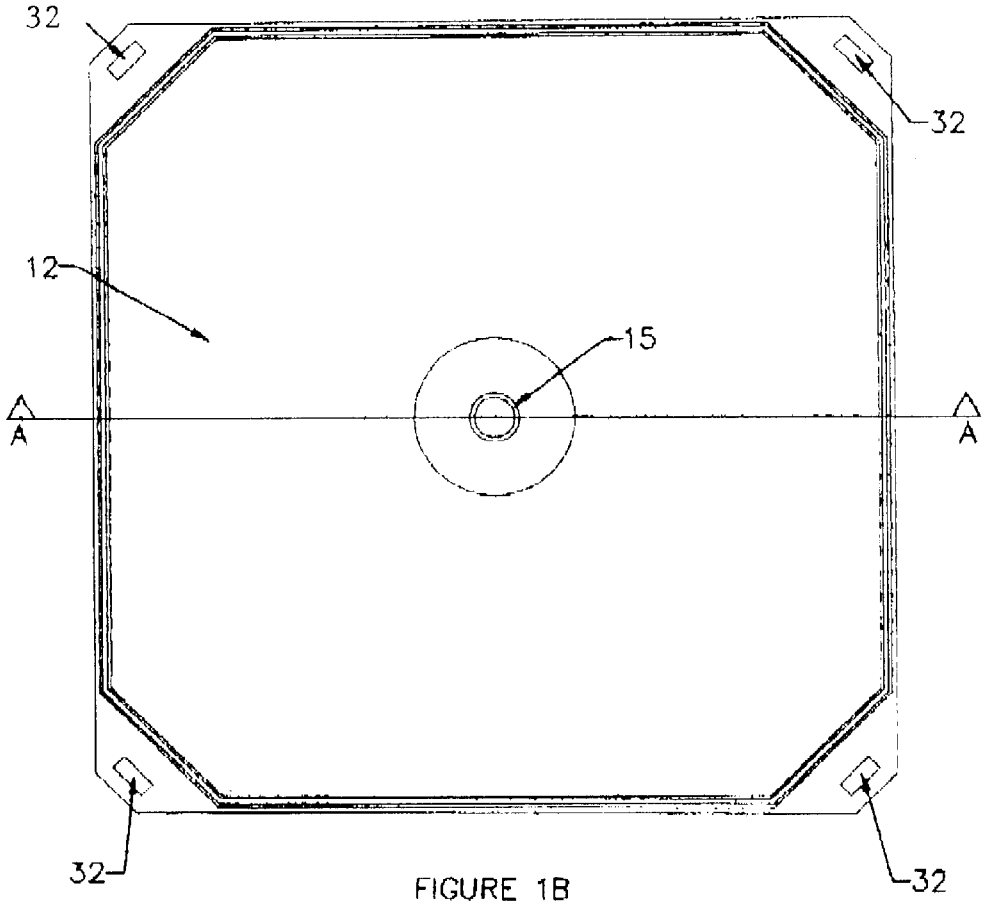
Figure 1C:
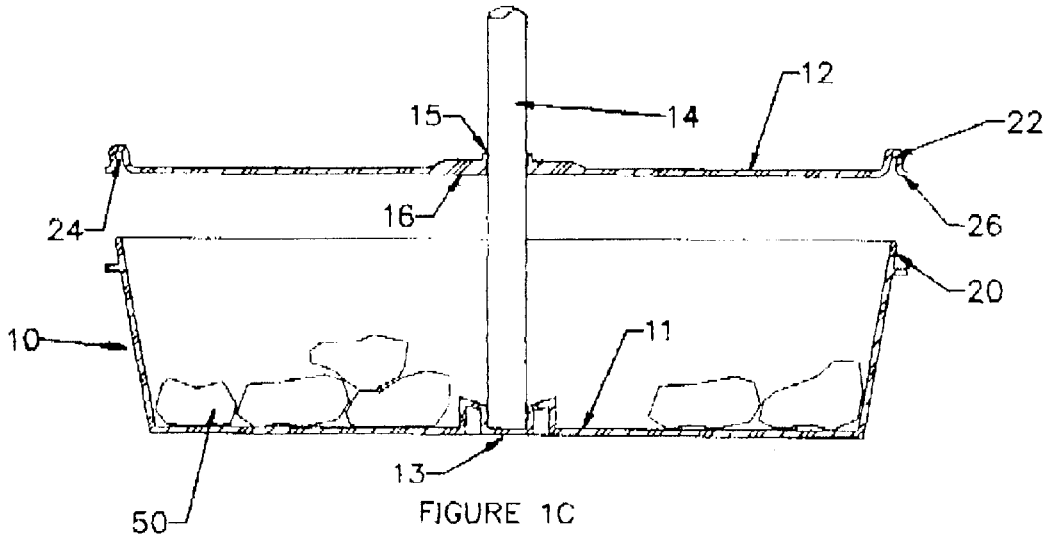
Figure 2:
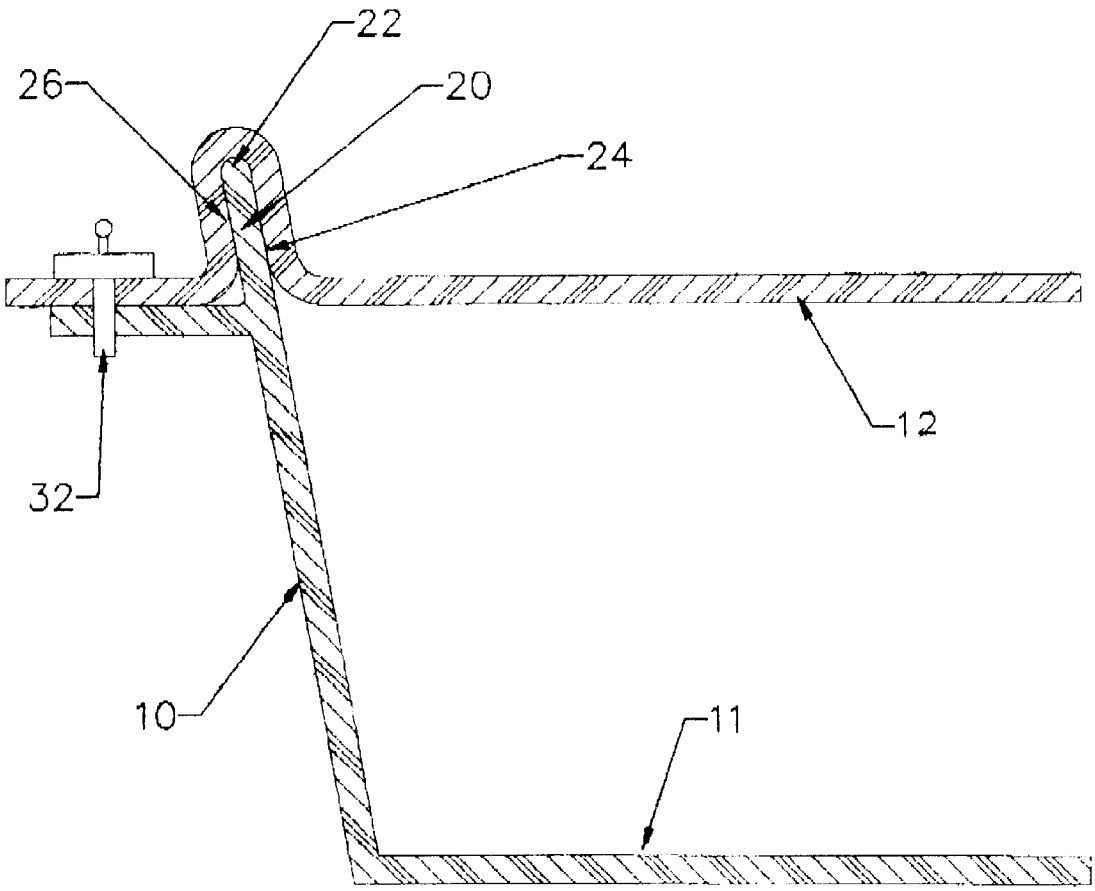
FIG. 2A is a plan view of a stand according to the invention.
FIG. 2B is an exploded side view of a cross section of the stand.

With reference to the drawings in FIG. 1 a general arrangement drawing is shown of stand according to this application, in use during play of a game of the tether tennis type, the stand being used on a hard surface;

in FIG. 2A a plan view is shown of a stand showing a detachable lid 12, the position of the four corner latches 32, which comprise the secondary attachment system, and the hole in the lid 15 for the pole;

FIG. 2B is an exploded cross-sectional view of the stand on the section IIB—IIB shown in FIG. 2A. This shows the base container 10 in the center of the floor 11 of which is a socket 13 which is designed to receive and hold the bottom end of a pole 14, which is mounted in the stand. The lid 12 is shown above the base container 10 preparatory to fitting the lid 12. The lid has a thickened section 16 adjacent to the hole for the pole 15, so as to reinforce the lid in this area.

Figure 3:
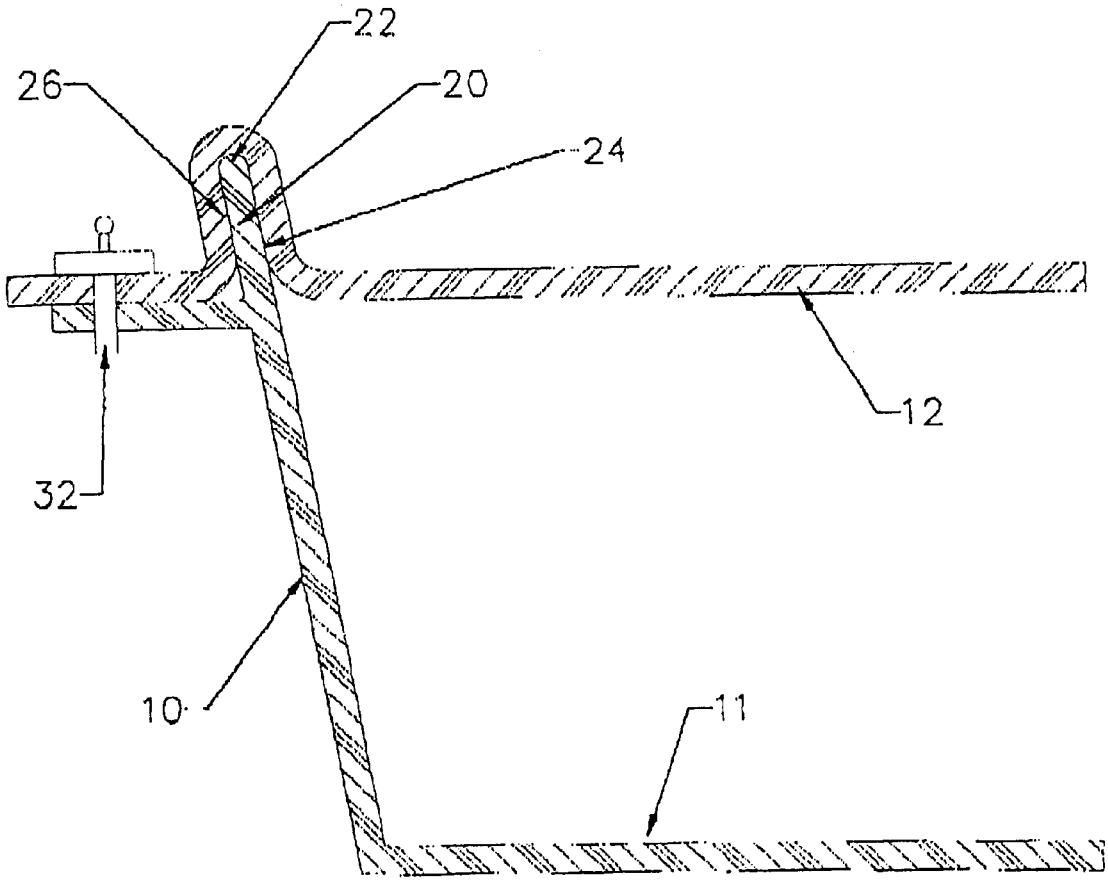
FIG. 3 is a detailed cross-sectional view of the stand showing the lid attached to the base, in the area of one of the four corner latches 32 shown in FIG. 2A, which comprise the secondary attachment system.

At the periphery of the lid 12 is shown a groove 22, having an inner wall 24, and outer wall 26 (see FIG. 3 for greater detail). The groove 212 is designed to fit closely over a tongue 20 at the periphery of the base container 10. Ballast material such as rocks or stones 50 are shown in place. Other ballast materials such as sand or water may be alternatively used.

FIG. 3 is an enlarged view of a cross-section of a potion of the base 10 with the lid 12 attached to the base in the corner area of the stand shown in FIG. 1, showing a latch 32 which secures the lid 12 to the base 10.

The latch 32 is one of the four latches shown in FIG. 2A which constitute the secondary attachment system. The tongue 20 at the periphery of the base 10 is shown inserted, to the maximum extent, into the groove 22 at the periphery of the lid 12, and is enveloped and closely held by the inner surface of the groove which includes the inner wall 24, and the outer wall 26, of the groove 22.

Figure 5:
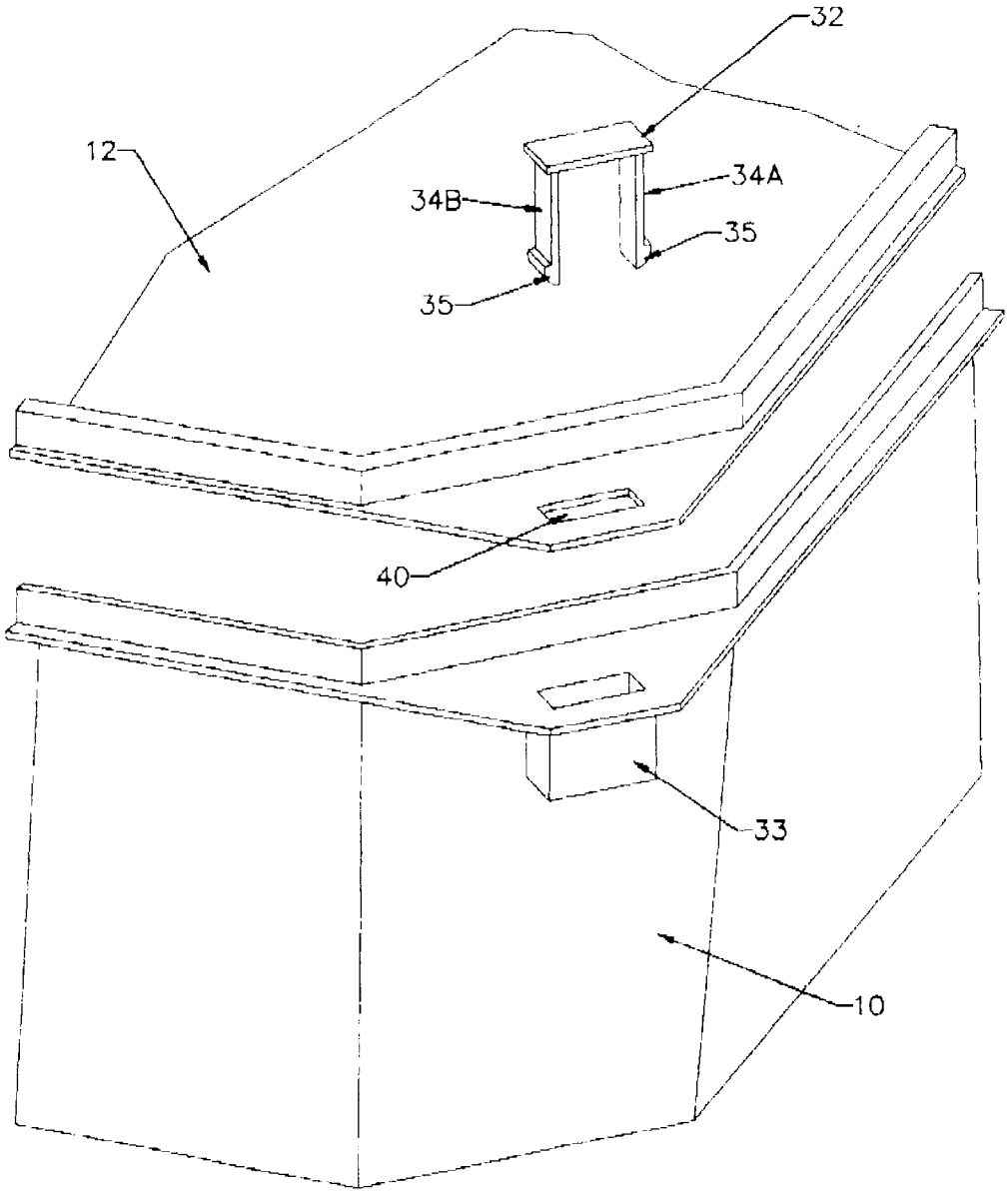
FIG. 5 is a drawing of one type of latch 32 which may be used as part of the secondary locking system prior to application to the lid and base, together with the lid and base components to which it is about to be attached.

The latch 32 may be of many different forms and for example, a simple nut and bolt arrangement may be used, although in this embodiment a latch of the type shown in FIG. 5 is preferred. In FIG. 3 the latch 32 is not drawn to any specific design;

FIG. 4 comprises four drawings, 4A, B, C and D which are enlargements of a cross section of the stand at the zone of the joint between a lid and a base container which comprises the primary attachment system, having a typical tongue and flexible groove seal where the apex of the tongue is larger than the mouth of the groove. These figures show progressive stages in the attachment of the tongue and groove joint. FIG. 4A shows the lid 12 in position adjacent to the upper area of the wall of the base container 10, prior to attachment to the base 10.

At the periphery of the base 10, a tongue 20 is shown which slopes outwardly at an obtuse angle 51, to the axis of the base container, the vertical line of which is indicated by line 50, shown in FIG. 4C, which mates with a complimentary flexible groove 22 at the periphery of the lid, such groove being defined by inner and outer walls 24 and 26 which, together with the apex (see FIG. 8A) comprise the inner surface of the groove, and which also slopes at an obtuse angle to the axis of the base container.

When the lid is presented to the base container with the object of attaching the lid to the base container, it will be seen that the groove in the lid will not freely slide down over the enlarged apex 27 of the tongue 20, which is larger than the opening of the groove 22 (see FIG.4B). The groove has to be initially pressed down over the enlarged apex 27 of the tongue 20.

Figure 4D:
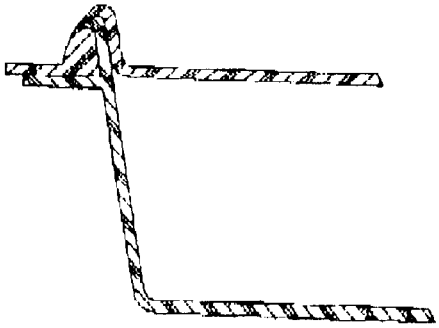

In this process the groove in the lid, being flexible, is forced open to accommodate the apex 27 of the tongue 20 (see FIG. 4C). The groove is then forced further down over the tongue, until the tongue is inserted to the maximum extent into the groove. FIG. 4D shows the tongue and groove in this closed position. In this position the tongue is enveloped and held closely by the groove, and the configuration of the groove, which provides for the enlarged apex of the tongue, has allowed the groove to snap back substantially to its normal unstressed position by virtue of its natural flexibility and springiness.

The enlarged apex of the tongue is comfortably accommodated within a corresponding cavity at the apex of the groove. This arrangement of tongue, fully inserted into a complimentary close fitting flexible groove, if correctly designed, gives an excellent watertight seal and resists sideways pressure from either side (as may be exerted in the plane of the lid by the pole during play of the tether tennis type games) as the tongue is held closely and supported on both sides by the walls of the groove.

Conversely, should it be desired to remove the lid and detach the tongue from the groove, pressure has to be applied to pull the tongue free from the groove by forcing the groove to open, so as to release the tongue.

In this configuration, the enlarged apex of the tongue, sitting inside the cavity at the apex of the groove, will tend to aid the positive restraint of the tongue within the groove, unless the groove is opened to enable the release of the tongue.

FIG. 5 shows a latch 32 of a type which may be used as an element of the secondary attachment system which positively attaches the lid to the base. This latch is preferably made of plastic and is similar in design to the quick release buckles used in back packs, camera cases and various types of travel goods.

The latch 32 has flexible arms 34A, 34B, which are free to bend towards each other when the latch is inserted down through the latch opening 40 in the lid 12, into the locking socket 33, which comprises part of the base 10.

The arms 34A, 34B have outwardly pointing hooks 35 at the end of the arms 34A, 34B. When the latch has been inserted to its fullest extent into the locking socket 33, the hooks 35 emerge from the confines of the locking socket 33 at the lower end thereof, enabling the flexible arms 34A, 34B to spring outwards towards their natural position in the unstressed state, so that the upper faces of the hooks 35 are positioned underneath the bottom edge of the locking socket 33, thereby preventing the removal of the latch unless the ends of the tips of the flexible arms 34A, 34B are squeezed together so as to remove the upper faces of the hooks 35 from underneath the bottom edge of the locking socket 33.

It will be appreciated that other (releasable) locking methods may be used as a secondary attachment means to securely and positively attach the lid to the base, such as hook and loop straps of the "VELCRO" (Trade Mark) type, or any other forms of releasable attachment, including clamps, catches, latches, twist locks, straps, ties, press-studs or snap fasteners, nut and bolt or screw arrangements, or the like.

FIGS. 6 and 7 show a section of the lid 12 fitted with an example of a type of removable clamp 30, which may be used to clamp the pole 14 into its mounted position. This clamp is used for applications requiring the positive locking of the pole into position. The lid 12 has been thickened at 16, so as to strengthen it in the area adjacent to the pole 14.

Various arrangements of tongue and groove joint are illustrated in drawings 8A to 8G, not all of which, as is explained below, are appropriate for a stand as described in this patent application.

Figure 8A:
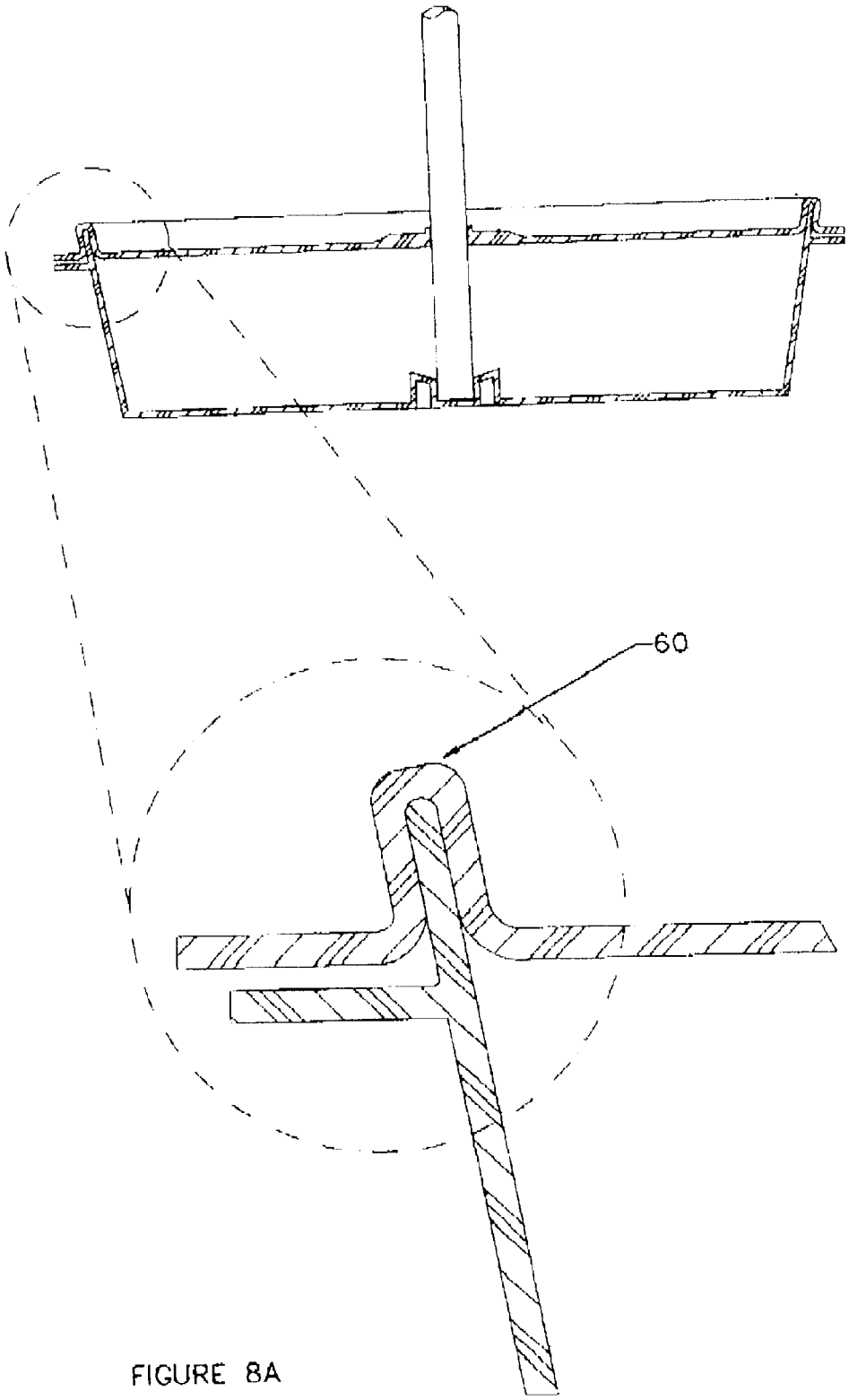
FIGS. 8A to 8G illustrate configurations of tongue and groove joints, some of which are suitable for a primary attachment system for this patent application.

FIG. 8A shows a cross sectional general arrangement of lid and base together with a close up view which illustrates the position 60 of the apexes of both the tongue and groove of the joint of the primary attachment system, when in the closed position.

Figure 8B:
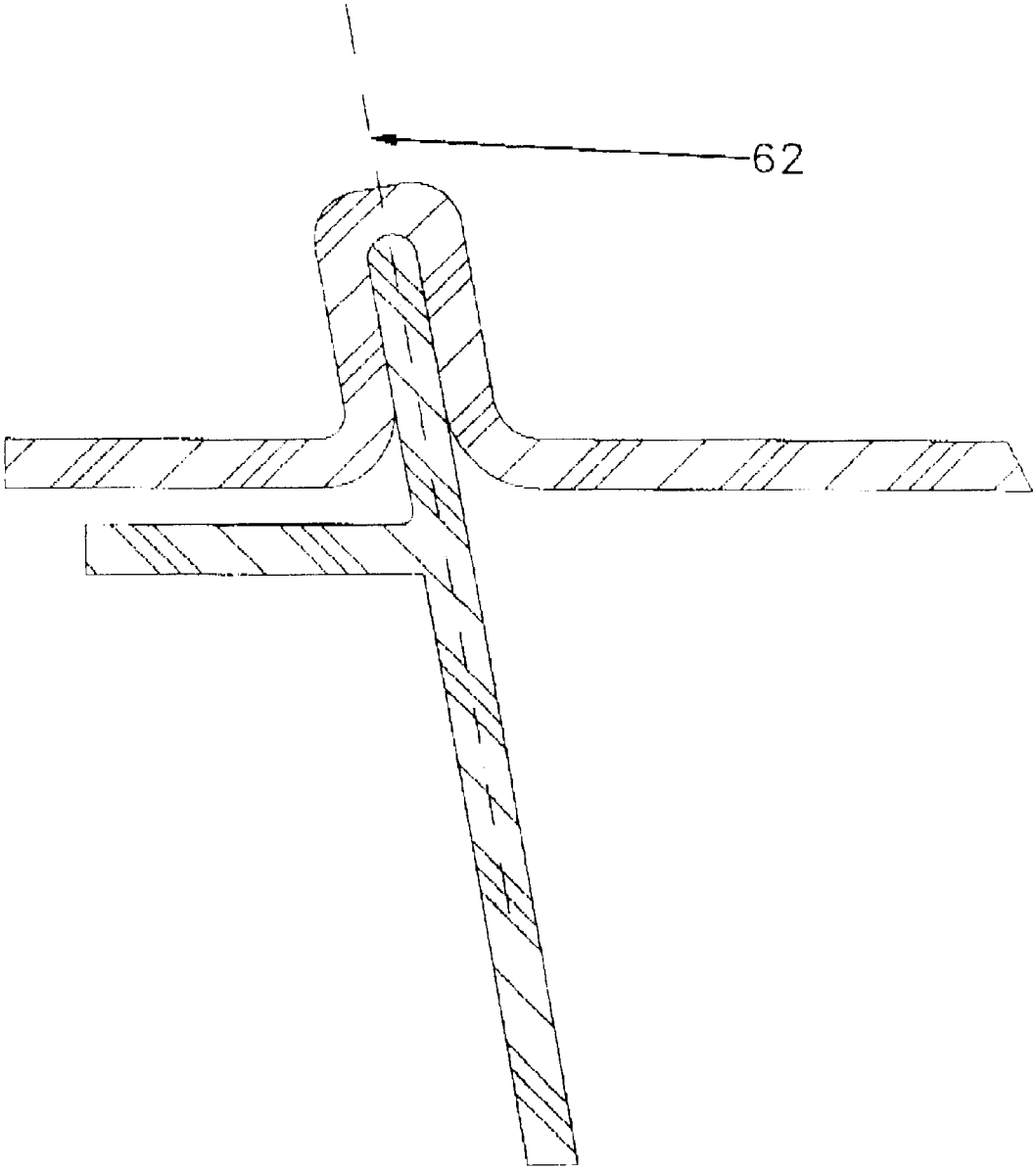

FIG. 8B shows a groove as per the close up view in FIG. 8A illustrating a tongue inserted into a groove with the walls of both parallel to the axis 62 of the tongue and groove along the full length of tile sides of the groove.

Figure 8C:
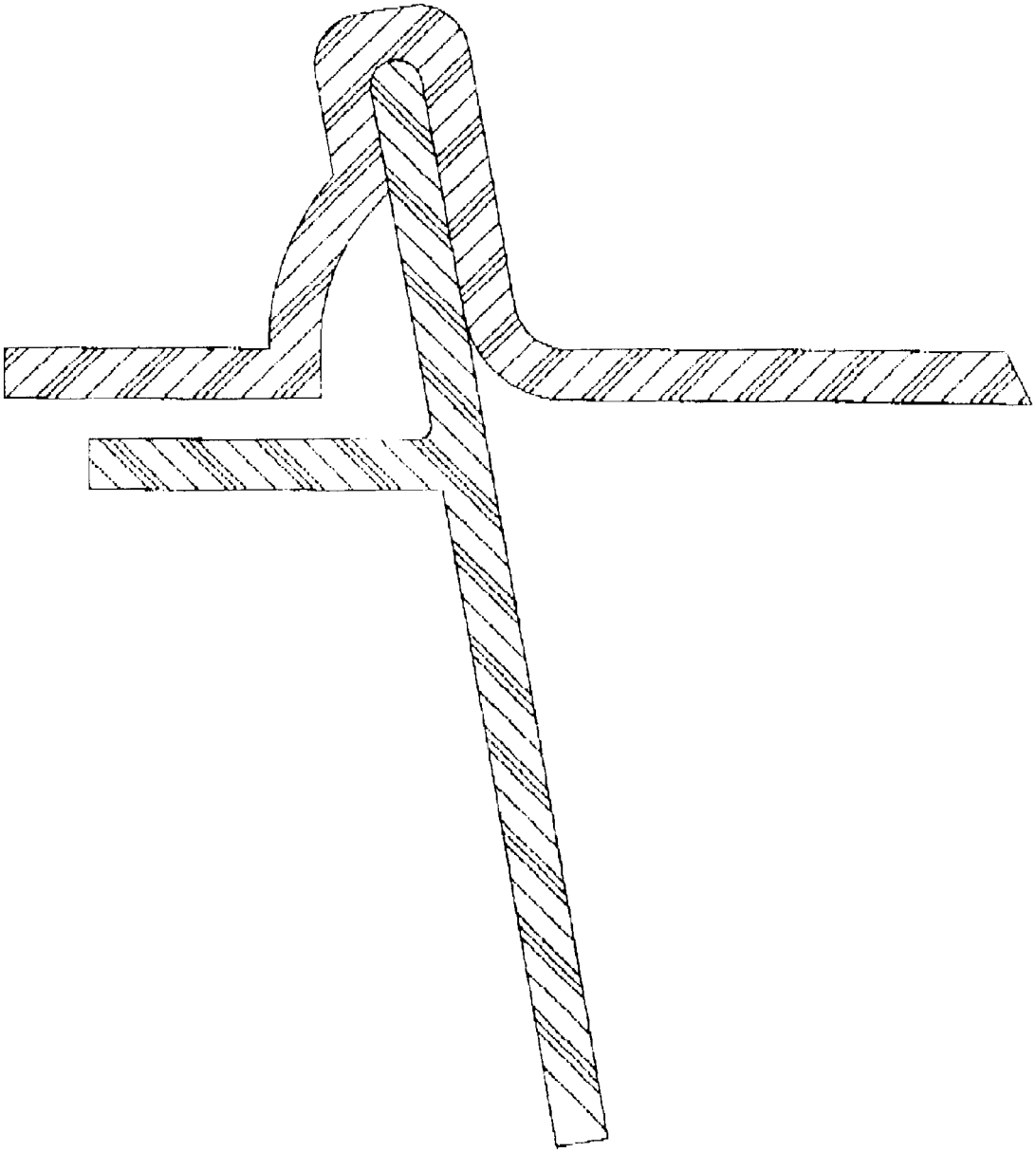

FIG. 8C shows a cross section of a groove with the tongue inserted in which the top section only of both the tongue and groove lie parallel to the axis of the tongue and groove. Below this section the wall of the groove does not abut the outer wall of the tongue and is at an angle inwardly towards the apex. Although this will tend to diminish the effectiveness of this seal, the extra length of the wall of the groove will tend to add to the strength of the seal even though it does not abut the outer wall of the tongue.

Figure 8D:
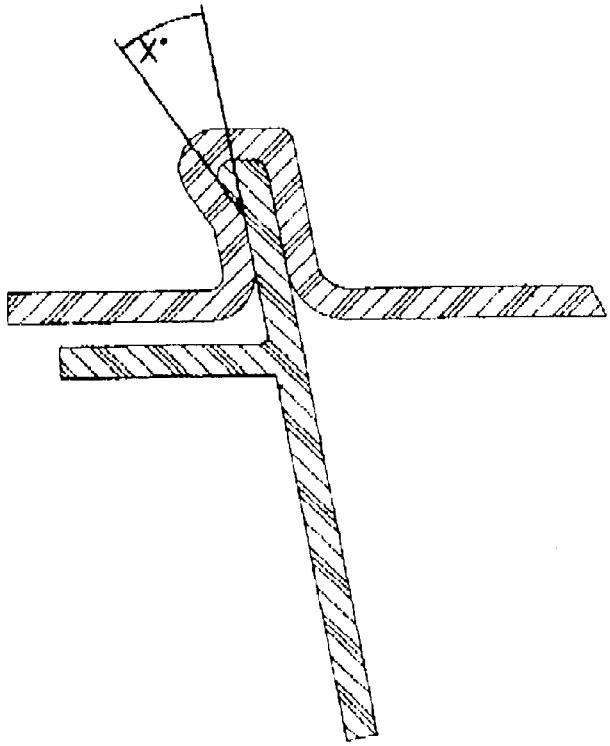

FIG. 8D shows a cross section of a groove and inserted tongue in which part of the outer wall of the tongue and the abutting face of the groove in this area diverge outwardly at angle x° from the parallel towards the apex in the area at the top of the apex, which tends to produce a very good seal.

Figure 8E:
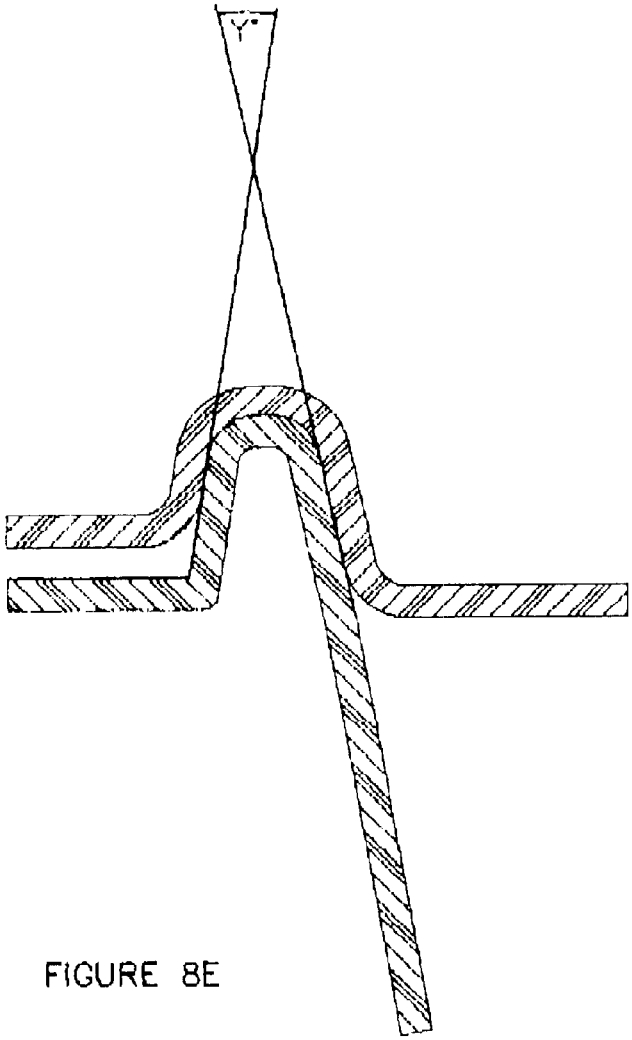

FIG. 8E shows a groove and inserted hollow tongue with both outer walls of the tongue and abutting inner walls of the groove converging inwardly towards the apex at angle y°. This will tend to produce a weak seal.

Figure 8F:
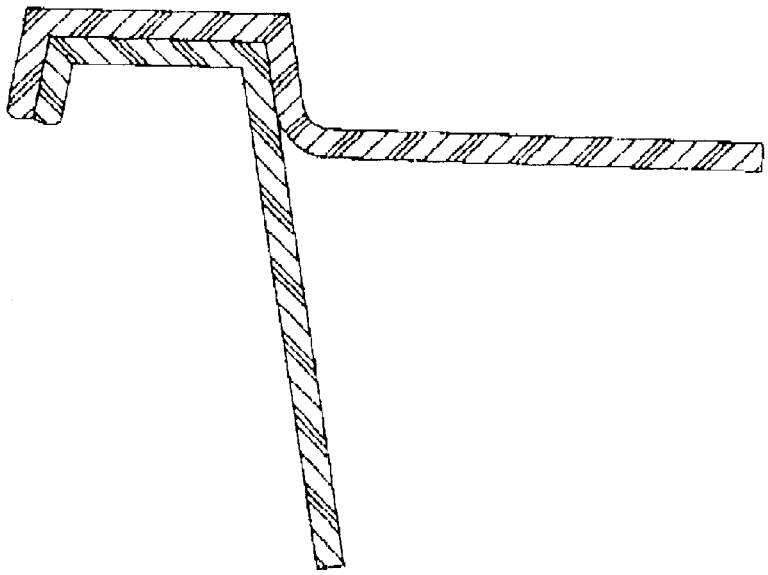

FIG. 8F shows a wide short hollow tongue is shown enveloped by a groove. While this arrangement will provide a joint which is resistant to lateral shocks even though the tongue is relatively wide in relation to its depth, it will not provide a watertight joint.

Figure 8G:
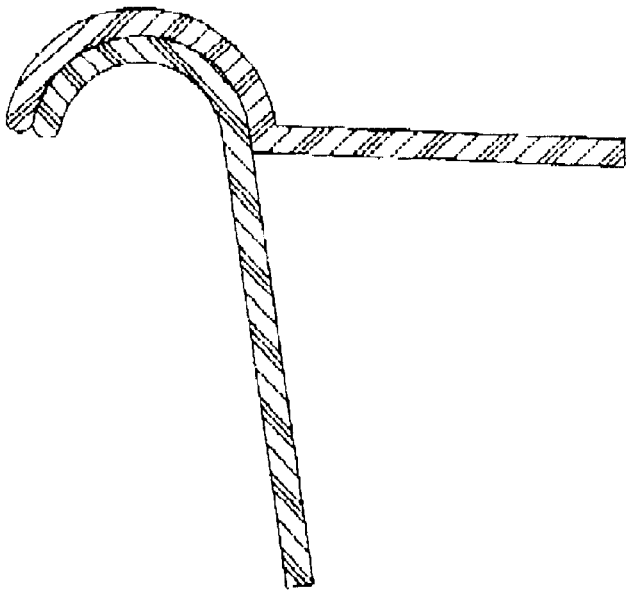

FIG. 8G shows a shallow joint layout which will not provide a strong seal and watertight joint and cannot really be described as a tongue and groove joint.

What is claimed is:

1. A movable stand for supporting a pole, comprising:

a pole having a first portion with a first external diameter;

a base container that is adapted to hold ballast and that comprises an open top and a socket on an interior floor of said base container for receiving a bottom of said pole;

a lid that is adapted to completely close said open top, said lid having a through-hole for receiving said first portion of said pole, said through-hole being in registration with said socket when said lid is attached to said base container, said through-hole having a fixed internal diameter that is substantially the same as said first external diameter of said first portion of said pole so that said lid resists lateral movement of said pole; and an attachment system for attaching said lid to said base container, said attachment system comprising, a primary attachment system comprising a tongue on a periphery of one of said base container and said lid and a complementary groove in a periphery of the other of said base container and said lid, said tongue fitting into and being enveloped and held closely by said groove when said lid is attached to said base container, and a secondary attachment system comprising at least two locking devices that selectively lock adjoining peripheries of said base container and said lid to prevent separation of said tongue from said groove.

2. The stand of claim 1, wherein said base container is watertight and adapted to hold liquid ballast.

3. The stand of claim 1, wherein said base container has an interior capacity of 0.5 to 1.0 cubic feet.

4. The stand of claim 1, wherein an annular portion of a said lid directly adjacent to said through-hole is thicker than a remainder of said lid.

5. The stand of claim 1, wherein said first portion of said pole comprises an annular clamp that extends into said through-hole and locks said pole in said through-hole, an exterior of said annular clamp having said first external diameter.

6. The stand of claim 1, wherein said base container and said lid have radially outwardly extended lips with corresponding orifices, and wherein each of said two locking devices extends through a respective pair of said corresponding orifices.

7. The stand of claim 1, wherein said two locking devices each comprise a nut and a corresponding bolt.

8. The stand of claim 1, wherein said two locking devices each comprise a latch that is generally U-shaped with distal ends that have hooks that latch an edge of a respective one of said orifices and that are unlatched when said distal ends are urged together.

9. The stand of claim 1, wherein said tongue and said groove have respective insertion and reception axes that are offset from each other.

10. A movable stand for supporting a pole, comprising:

a pole having a first portion with a first external diameter;

a base container that is adapted to hold a ballast and that comprises an open top;

a lid that is adapted to completely close said open top, said lid having a through-hole for receiving said first portion of said pole, an annular portion of a said lid directly adjacent to said through-hole being thicker than a remainder of said lid, said through-hole having a fixed internal diameter that is substantially the same as said first external diameter of said first portion of said pole so that said lid resists lateral movement of said pole;

an annular clamp defining said first portion of said pole that extends into said through-hole and locks said pole in said through-hole, an exterior of said annular clamp having said first external diameter; and an attachment system for attaching said lid to said base container, said attachment system comprising, a primary attachment system comprising a tongue on a periphery of one of said base container and said lid and a complementary groove in a periphery of the other of said base container and said lid, said tongue fitting into and being enveloped and closely held by said groove when said lid is attached to said base container, and a secondary attachment system comprising at least two locking devices that selectively lock adjoining peripheries of said base container and said lid to prevent separation of said tongue from said groove.

11. The stand of claim 10, further comprising a socket on an interior floor of said base container for receiving a bottom of said pole, said socket being in registration with said through-hole when said lid is attached to said base container.

12. The stand of claim 10, wherein said base container is watertight and adapted to hold liquid ballast.

13. The stand of claim 10, wherein said base container has an interior capacity of 0.5 to 1.0 cubic feet.

14. The stand of claim 10, wherein said base container and said lid have radially outwardly extended lips with corresponding orifices, and wherein each of said two locking devices extends through a respective pair of said corresponding orifices.

15. The stand of claim 10, wherein said two locking devices each comprise a nut and a corresponding bolt.

16. The stand of claim 10, wherein said two locking devices each comprise a latch that is generally U-shaped with distal ends that have hooks that latch an edge of a respective one of said orifices and that are unlatched when said distal ends are urged together.

17. The stand of claim 10, wherein said tongue and said groove have respective insertion and reception axes that are offset from each other.

* * * * *